United States Patent [19]

Basques

[11] Patent Number: 4,773,866

[45] Date of Patent: Sep. 27, 1988

[54] ROTATABLE ELECTRICAL CONNECTOR

[76] Inventor: Eric O. Basques, 9328 Curtsey Ct., Columbia, Md. 21045

[21] Appl. No.: 911,792

[22] Filed: Sep. 26, 1986

[51] Int. Cl.[4] ..... H01R 39/00

[52] U.S. Cl. ..... 439/21; 439/22; 439/26; 439/364; 379/438

[58] Field of Search ..... 339/1-8, 339/97 R, 182, 183, 177 R, 177 E, 179, 154-156, 176 M, 41, 91 R, 91 P, 256, 258, 92; 379/438

[56] References Cited

U.S. PATENT DOCUMENTS

| | | | |
|---|---|---|---|
| 810,244 | 1/1906 | Wright | 339/8 R |
| 1,631,575 | 6/1927 | Berry | 339/8 P |
| 1,894,187 | 1/1933 | McGregor | 339/6 |
| 2,419,683 | 4/1947 | Henschke | 339/97 R |
| 2,941,177 | 6/1960 | Merritt | 339/8 |
| 3,123,421 | 3/1964 | Phillips | 339/8 |
| 3,195,094 | 7/1965 | Mohr | 339/8 |
| 3,387,250 | 6/1968 | Bjorn et al. | 339/8 |
| 3,437,976 | 4/1969 | Nelson | 339/8 |
| 3,599,165 | 8/1971 | Wendell et al. | 339/5 |
| 3,847,463 | 11/1974 | Hayward et al. | 339/8 P |
| 3,972,577 | 8/1976 | Charles et al. | 339/5 L |
| 4,472,010 | 9/1984 | Parnello | 339/8 R |
| 4,533,796 | 8/1985 | Engelmore | 339/8 R |
| 4,583,798 | 4/1986 | Blazowich | 339/8 R |
| 4,590,337 | 5/1986 | Englemore | 379/438 |

FOREIGN PATENT DOCUMENTS

| | | |
|---|---|---|
| 1152459 | 8/1963 | Fed. Rep. of Germany . |
| 106382 | 5/1965 | Netherlands . |
| 917275 | 12/1972 | Canada . |

*Primary Examiner*—David Pirlot

*Attorney, Agent, or Firm*—Antonelli, Terry & Wands

[57] ABSTRACT

A rotatable electrical connector for use with telephone cords comprises first and second connector members which are connected together for rotation with respect to each other about an axis of rotation. A plurality of concentric electrically conductive contact rings are provided on one of the connector members about the axis of rotation in radially spaced relationship so as to face the other connector member. The other connector member has a plurality of sliding electrical contacts in electrical contact with respective ones of the plurality of concentric electrically conductive rings on the one connector members so as to remain in electrical contact with relative rotation of the connector members. The plurality of concentric conductive contact rings are located in a single plane which is perpendicular to the axis of rotation so that the connector is compact axially.

12 Claims, 3 Drawing Sheets

ROTATABLE ELECTRICAL CONNECTOR

BACKGROUND AND SUMMARY OF THE INVENTION

The present invention is directed to an improved rotatable electrical connector. More particularly, the invention relates to an improved electrical connector for use with telephone cords, such as coiled telephone cords, to prevent the cord from becoming twisted and/or "knotted-up".

Numerous rotatable electrical connectors for use with telephone cords have been proposed. For example, in U.S. Pat. No. 2,414,957 a swivel connector is disclosed wherein the main body has a turning head rotatably fitted thereon via a ball raceway and bearing balls. A central current conductor in the form of a rod is employed with intermediate and outer current conductors which are of tubiform. Terminal parts are associated with each of the conductors. This known type of swivel connector is relatively bulky, requires a substantial number of components, and hence is relatively expensive to make and may also be prone to breakage and to not affording a low friction rotation which would obviate its usefulness.

More recently, a rotatable electrical connector for telephone cords is disclosed in U.S. Pat. No. 4,533,796 wherein a hollow inner cylindrical member is telescoped within a hollow outer cylindrical member with a pair of ball bearing members supporting the outer member on the inner member for rotation about a central longitudinal axis. The exterior of the outer member supports a plurality of split conductive rings spaced along the central longitudinal axis that are in alignment with respective continuous rings on the inner member. A plurality of apertures are formed in the wall of the outer member in alignment with the conductive rings, and these apertures contain spring-biased balls in rolling contact with the rings so as to maintain good electrical continuity between the innermost continuous rings and the outermost split rings. This known connector is relatively complex, it requires a substantial number of parts, is rather bulky in terms of its length, and relatively costly to make. It also may be prone to breakage and friction problems.

An object of the present invention is to provide an improved rotatable electrical connector which avoids the aforementioned disadvantages of the known rotatable electrical connectors for telephone cords and the like. More particularly, an object of the invention is to provide an improved rotatable electrical connector which is sturdy enough to withstand abuse such as pulling and impact, requires only a minimum number of parts, offers low frictional resistance to rotation, and is very compact and economical to produce.

These and other objects of the invention are attained by the provision of the rotatable electrical connector of the invention. The connector comprises first and second connector members. Means are provided for rotatably connecting the first and second connector members together for rotation with respect to each other about an axis of rotation which extends through the connector members. A plurality of concentric electrically conductive rings are provided on the first connector member about the axis of rotation in radially spaced relationship so as to face the second connector member. The second connector member is provided with a plurality of sliding electrical contacts, which are in electrical contact with respective ones of the plurality of concentric electrically conductive rings on the first member so as to remain in electrical contact with relative rotation of the first and second conductive members.

According to the disclosed, preferred embodiment of the invention, the plurality of concentric conductive rings are located in a single plane which traverses the axis of rotation. More particularly, the single plane is perpendicular to the axis of rotation. This permits the axial length of the rotatably electrical connector to be relatively small, so that the connector is compact. The sliding electrical contacts are yieldably biased in electrical contact with the respective rings.

In one form of the invention, the means for rotatably connecting the first and second connector members together comprises one of the first and second connector members being telescoped within the other. The other connector member is provided with a radially inwardly directed flange extending from an outer surface of the connector about a portion of the one connector to hold the one connector in telescoped position within the other connector member while permitting relative rotation of the first and second connector members about the axis of rotation. The flange can be coated or made from a low friction material such as Teflon, for example, to minimize sliding friction between the connector members during relative rotation. In another form of the invention, the means for rotatably connecting the first and second connector members comprises a fastener extending between the connector members along the axis of rotation. Respective parts of the fastener can be formed integrally with the connector members.

An outer end of one of the first and second connector members has a female electrical socket member and an outer end of the other connector member has a male electrical plug member. Each of the male and female members is adapted to make electrical connection with a separate set of electrical conductors. Means are provided in the connector for electrically connecting each separate conductive ring and each separate sliding electrical contact to the one of the male and female members that is on the outer end of its connector member. The sliding electrical contacts are yieldably biased against respective ones of the concentric conductive rings to maintain electrical contact during relative rotation of the first and second connector members. Standard four wire telephone connections can be made employing three concentric conductive rings and an additional electrically conductive contact located on the axis of rotation with a corresponding sliding electrical contact being provided in the second connector member in electrical contact with the additional contact in the first member. Alternatively, four concentric electrically conductive rings can be employed as with the use of a fastener extending between the connector members along the axis of rotation. Presently, a telephone uses four electrical contacts. However, the exact number of rings and their respective opposing contacts can of course be varied if future needs dictate. Other non-telephone uses of this invention may require more or less than the four contacts required for telephones.

The rotatable electrical connector of the invention is advantageously connected at one end to a telephone and at its other end to a telephone cord to prevent the cord from becoming twisted and/or "knotted-up". The connector is also useful for linking two telephone cords.

The connector of the invention can also be built into the telephone as an integral part thereof or, alternatively, could be built into a wall socket. The rotatable electrical connector of the invention is simple, and expensive to make, sturdy and effective for the intended purpose.

These and other objects, features and advantages of the invention will become more apparent from the following description when taken in connection with the accompanying drawings which show, for purposes of illustration only, several embodiments in accordance with the invention.

DETAILED DESCRIPTION OF THE DISCLOSED EMBODIMENT

Figure 1:
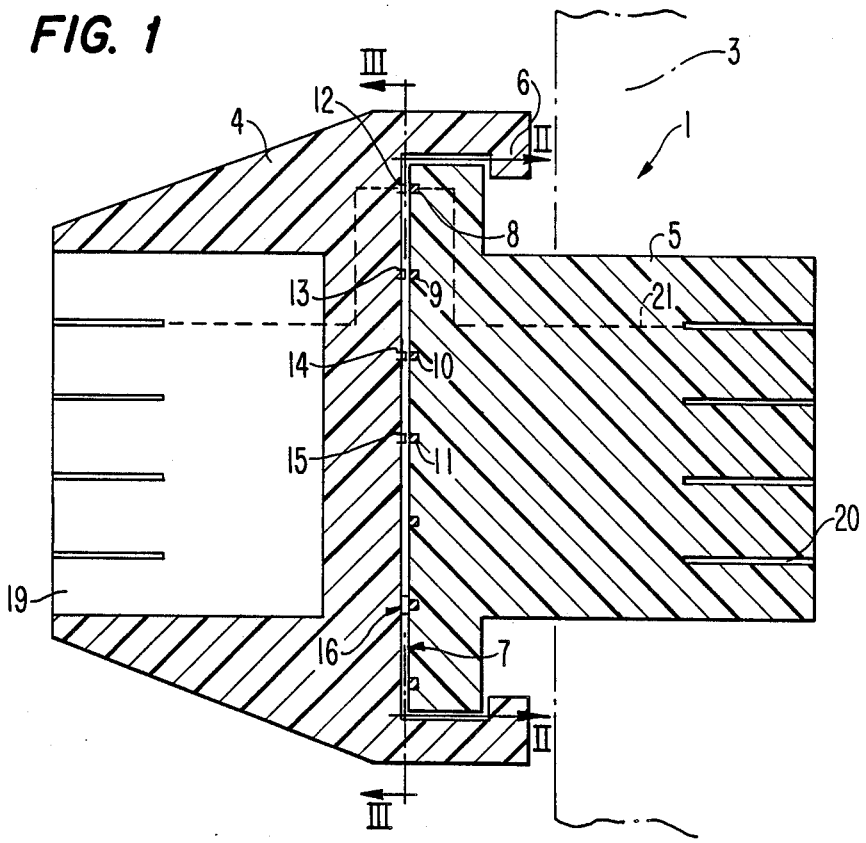
FIG. 1 is a cross-sectional view taken along the axis of rotation of a rotatable electrical connector according to a first, preferred embodiment of the invention.
Figure 2:
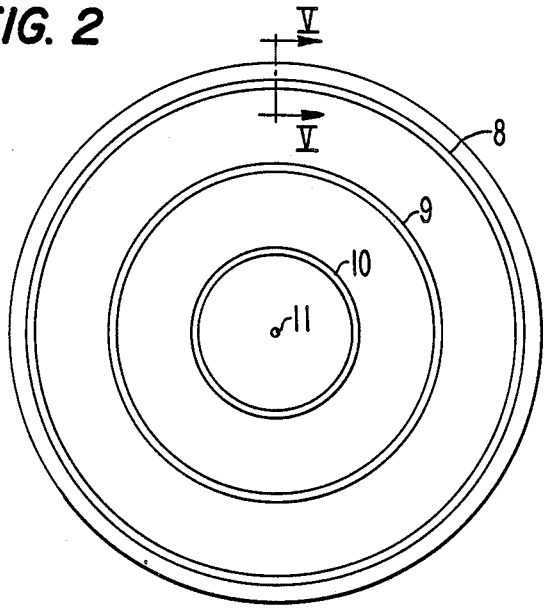
FIG. 2 is a sectional view taken along the line II—II in FIG. 1 and depicting an end view of one connector member of the rotatable electrical connector having a plurality of concentric electrically conductive rings.
Figure 3:
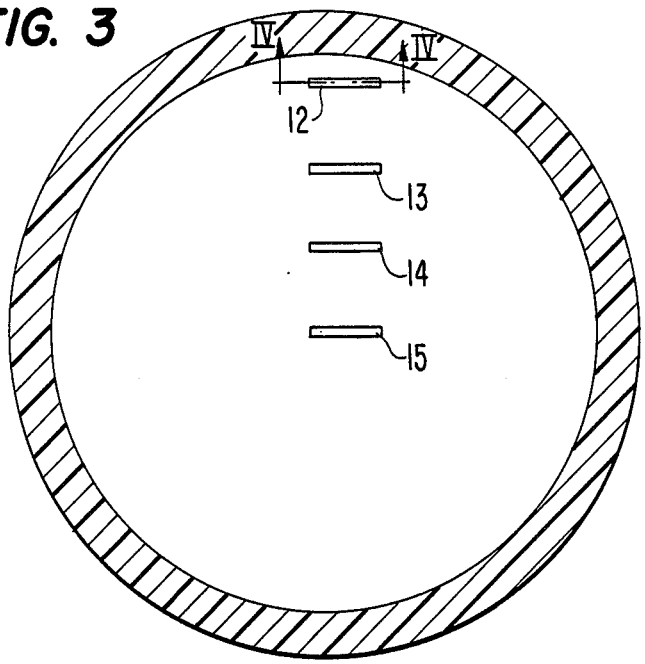
FIG. 3 is a sectional view of the rotatable electrical connector of FIG. 1 taken along the line III—III and showing an end face of the second connector member with a plurality of sliding electrical contacts thereon which face the end face of the first connector member and which are in electrical contact with respective ones of the concentric conductive rings on the first connector member.
Figure 4:
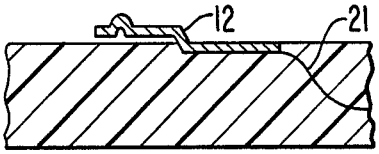
FIG. 4 is a cross-sectional view taken along the line IV—IV in FIG. 3 and showing a sliding electrical contact supported on the second connector member.

Referring now to the drawings, a rotatable electrical connector 1 of the invention is shown in FIGS. 1-5. The low friction rotatable electrical connector 1 is shown in use with a telephone cord 2 at the connection of the telephone cord and a telephone handset 3 having a telephone transmitter and receiver therein, see FIG. 9, to prevent the cord from becoming twisted and/or "knotted-up". The connector 1 comprises a pair of connector members 4 and 5 which are connected adjacent to one another for rotation with respect to each other about an axis of rotation A.

In the embodiment illustrated in FIGS. 1-5, the means for rotatably connecting the connector members 4 and 5 includes an arrangement wherein the connector member 5 is telescoped within the connector member 4. The connector member 4 is provided with a radially inwardly directed flange 6 which extends from an outer surface of the member 4 about a portion of the connector member 5 to hold the connector 5 in telescoped position within the connector member 4 while permitting relative rotation of the connector members about the axis of rotation A. During assembly of the connector 1, the flange 6 can be bonded or otherwise fastened to the remainder of the first connector member 4 after the second connector member 5 has been telescoped within the first connector member, in order to securely locate and retain the second connector member 4 in the position shown in FIG. 1. The connector members 4 and 5 are preferably formed of an insulating plastic material as by injection molding, for example. Adjacent surfaces of the connector members 4 and 5 which can contact one another during relative rotation of the connector members may be coated with or made from Teflon® or another low friction-type material to minimize sliding friction between the connector members. Preferably, at least the surfaces of the flange 6 adjacent the second member 5 are coated with such a material. Connector members 4 and 5 may also be manufactured using materials which are inherently low friction.

A flat face 7 of the connector member 5 has formed thereon three concentric electrically conductive contact rings 8, 9 and 10 which are concentric about the axis of rotation A and in radially spaced relationship with respect to each other so as to face the connector member 4. An additional electrically conductive contact 11 is also provided on the flat face 7 at the axis of rotation A. The conductive contact 11 and contact rings 8, 9 and 10 are formed of an electrically conducting material, such as copper which is applied to the flat face 7 of the connector membe 5. The contact 11 and contact rings 8, 9 and 10 could be stamped or formed of a thin electrically conductive plate or foil or as by coating using standard printed circuit manufacturing techniques.

Figure 6:
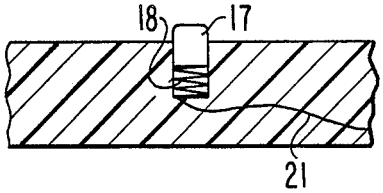
FIG. 6 is a cross-sectional view similar to FIG. 4 and illustrating another form of sliding electrical contact which can be used with the connector of FIG. 1.
Figure 5A:
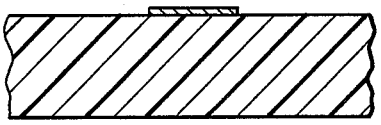
FIG. 5*a* is a cross-sectional view of the one connector member shown in FIG. 2 taken along the line V—V.
Figure 5B:
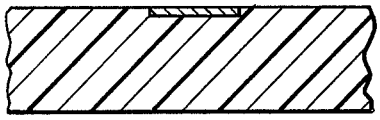
FIG. 5*b* is an alternate form for the connector member shown in FIG. 5*a;*

Four sliding electrical contacts 12, 13, 14 and 15 are located on the flat face 16 of the connector member 4 so as to be in electrical contact with respective ones of the plurality of concentric electrically conductive rings 8, 9 and 10 and the additional electrically conductive contact 11 on the face 7 of the connector member 5. The sliding electrical contacts 12, 13, 14 and 15 are spring biased against respective ones of the concentric conductive rings 8, 9 and 10 and the additional electrically conductive contact 11 so as to remain in electrical contact with relative rotation of the connector members 4 and 5. The inherent resilience of the copper sliding electrical contact 12 shown in FIG. 4 serves to yieldably bias the contact in the direction of the opposite contact ring 8. Alternatively, the sliding electrical contacts could be in the form of copper pins 17 as shown in FIG. 6 with coil springs 18 being provided to bias the respective pins in the direction of the contact rings and the additional electrically conductive contact on the axis A. The sliding contacts could also have other forms as will be apparent to one skilled in the art.

Figure 9:
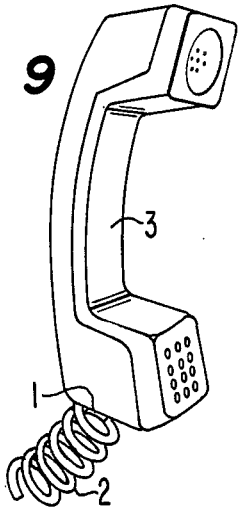
FIG. 9 is a perspective view of a telephone handset which is a combination telephone transmitter and receiver and wherein the rotatably electrical connector is connected at one end directly to the handset with a telephone cord being connected at the other end of the connector.

The outer end of the connector member 4 is formed with a standard female telephone modular plug 19 with four conductors or wires. The outer end of the connector member 5 has a standard male telephone modular plug 20 with four conductors or wires. Electric wires 21 embedded in the connector members 4 and 5 electrically connect each separate conductive ring and the central contact and each separate sliding electrical contact to the one of the male and female members 19 and 20 that is on the outer end of its connector member. Thus, the connector 1 provides four separate conductive paths through the connector from the female plug 19 to the male plug 20 while permitting the connector members 4 and 5 to rotate relative to one another without interrupting the electrically conductive paths through the connector. In use, the male plug 20 of the connector 1 is connected to a combination transmitter and receiver telephone handset as shown in FIG. 9 and a telephone cord 2 is connected to the female plug 19 of the connector. As the handset is rotated during repeated use of the telephone handset, the connector 1 of the invention allows the handset to rotate relative to the coiled telephone cord 2 to prevent it from becoming twisted and/or "knotted-up". The connector members 4 and 5 of the connector are made sufficiently sturdy to withstand abuse such as pulling and impact which may occur during the normal use of the telephone. The connector 1 of the invention can have a variety of external designs or shapes, sizes and colors, including clear, as will be readily understood by one skilled in the art without departing from the present invention. The connector of the invention can also be used at the end of the telephone cord opposite the handset and has utility in joining two telephone cords to make a long cord.

Figure 7:
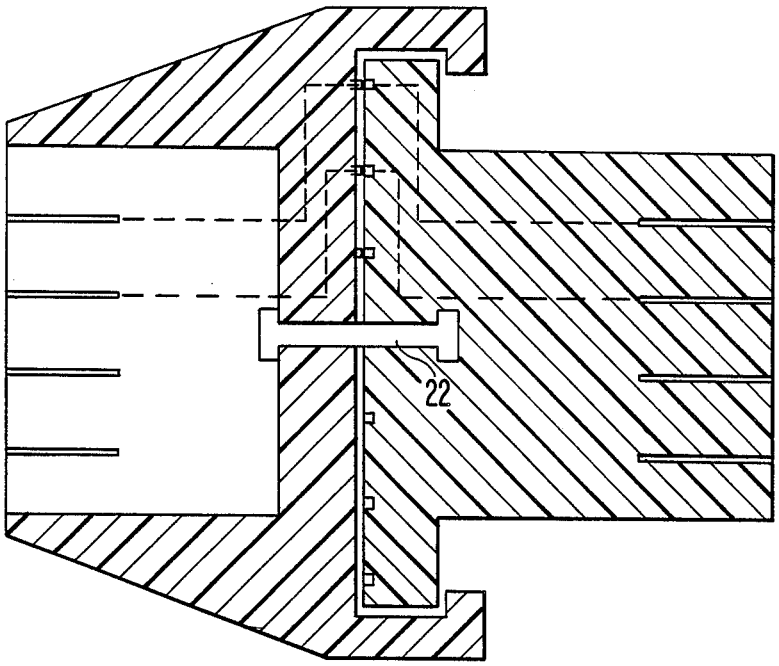
FIG. 7 is a cross-sectional view similar to FIG. 1 and depicting a fastener along the axis of rotation for rotatably connecting the connector members together.

As shown in FIG. 7 of the drawings, the connector of the invention need not be provided with the flange 6 as shown in FIG. 1. Instead, or in addition to the use of the flange 6, a fastener 22 can be provided for connecting the connector members 4 and 5 along the axis of rotation A so as to permit relative rotation of the connector members about the axis rotation. This fastener 22 may also act as a spacer to keep the two members 4 and 5 at proper distance for optimum electrical contact. With this arrangement, four concentric contact rings are radially spaced from one another on the flat face 7 of the connector member 5 as the central conductive contact 11 is replaced by means of the fastener 22. The fastener 22 can be a bolt, for example, or interlocking members which are formed integrally with the connector members 4 and/or 5 so that the connector 1 is formed of essentially only two moving parts as in the embodiment of Figs. 1–5.

The fastener 22 is embedded connector member 5 as shown in FIG. 7.

Figure 8A:
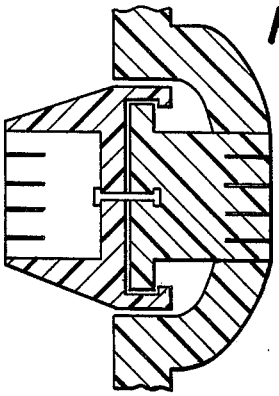
FIGS. 8*a, b* and *c* are respective cross-sectional views of different forms of a second embodiment of the invention wherein the rotatable electrical connector of the invention is formed as a part of a telephone handset combination transmitter and receiver or placed in a wall outlet rather than being an add on therefor as in the first disclosed embodiment.
Figure 8B:
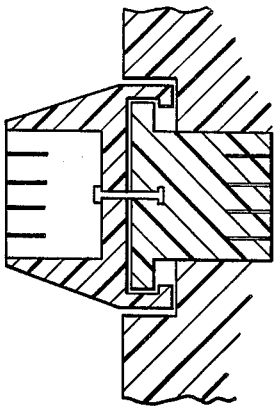
Figure 8C:
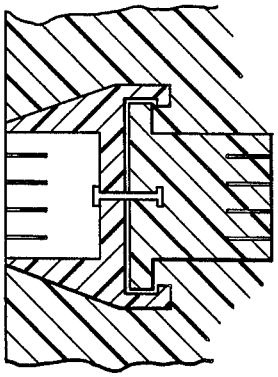

The connector of the invention can also be formed integrally with a telephone or in a wall socket for eliminating twisting and/or "knotted-up" cords connected thereto. FIGS. 8*a, b* and *c* of the drawings illustrate a wall portion 23 of a telephone or wall socket in which a connector 1 according to the invention is integrated at the time of construction of the telephone or wall socket. The standard female telephone modular plug 19 at the outer end of the connector 1 receives the cord 2 and permits relative rotation of the cord with respect to the connector and the associated telephone or wall socket. For example, connection is made to a handset as shown in FIG. 9. If integrated at the time of construction of the telephone handset, modular plug use would not necessarily be required, making the connector even more compact.

The several forms of the invention disclosed herein are simple in design, inexpensive to make, sturdy and effective for their intended purpose. Each requires only a minimum number of parts, essentially two moving parts, and is very compact so as to be unobtrusive to the user. Further, while I have shown and described only several embodiments in accordance with the present invention, it is understood that the same is not limited thereto, but is susceptible of numerous changes and modifications as known to those skilled in the art. The concept of this rotatable connector can be used with electrical connecting cords other than in telephones with from one to several electrical leads. This could include electrical wall outlet sockets, camera flash cords, computer cords, headphones, CB's, irons, vacuum cleaners, hand drills, power saws, appliance cords, or other types of electrical equipment where there is a desire to prevent twisted cords. Therefore, I do not wish to be limited to the details shown and described herein, but intend to cover all such changes and modifications as are encompassed by the scope of the appended claims.

I claim:

1. In a telephone equipment having a female telephone plug electrical connector located within said telephone equipment and formed integrally with said telephone equipment at the time of construction of said equipment for electrically connecting said telephone equipment with a telephone cord, the improvement comprising an electrical connector including first and second connector members, means rotatably connecting said first and second connector members for rotation with respect to each other about an axis of rotation, a plurality of concentric electrically conductive rings provided on said first connector member about said axis of rotation in radially spaced relationship so as to face said second connector member, the second connector member being provided with a plurality of sliding electrical contacts in electrical contact with respective ones of said plurality of concentric electrically conductive rings on the first member so as to remain in electrical contact with relative rotation of said first and second connector members, one of said first and second members being electrically connected with said telephone equipment and the other providing said female telephone plug of said equipment adapted to be electrically connected to a telephone cord, said means for rotatably connecting said first and second connectors comprises a fastener extending between and connecting said connector members along said axis of rotation so as to permit relative rotation of said connector members about said axis of rotation, said fastener being embedded within at least one of said first and second connector members.

2. The telephone equipment according to claim 1, wherein said plurality of sliding electrical contacts are yieldably biased against respective ones of said concentric conductive rings.

3. The telephone equipment according to claim 1, wherein said fastener connects said connector members in predetermined spaced relationship to one another.

4. The telephone equipment according to claim 1, wherein said plurality of concentric electrically conductive rings comprises at least three electrically conductive, concentric rings.

5. The telephone equipment according to claim 1, wherein said telephone equipment is a telephone.

6. The telephone equipment according to claim 1, wherein said telephone equipment is a wall socket.

7. The telephone equipment according to claim 1, wherein said electrical connector is located at least predominately within said telephone equipment.

8. The telephone equipment according to claim 1, wherein at least essentially the entire electrical connector is located within said telephone equipment.

9. The telephone equipment according to claim 1, wherein said plurality of concentric conductive rings are located in a single plane which traverses said axis of rotation.

10. The telephone equipment according to claim 9, wherein said single plane is perpendicular to said axis of rotation.

11. The telephone equipment according to claim 1, wherein said means for rotatably connecting said first and second connector members further includes one of said first and second connector members being telescoped within the other, the other connector member having a radially inwardly directed flange extending from an outer surface thereof about a portion of said one connector member to hold said one connector member in telescoped position within the other connector member while permitting relative rotation of said first and second connector members about said axis of rotation.

12. The telephone equipment according to claim 11, wherein at least said flange is coated with or made from a low friction material to minimize sliding friction between said first and second connector members during relative rotation.

* * * * *